US006598540B2

(12) United States Patent
Austin et al.

(10) Patent No.: US 6,598,540 B2
(45) Date of Patent: Jul. 29, 2003

(54) PALLET COVER

(75) Inventors: Michael D. Austin, Flushing, MI (US); James H. Niedzielski, Fenton, MI (US)

(73) Assignee: Atlas Technologies, Inc., Fenton, MI (US)

( * ) Notice: Subject to any disclaimer, the term of this patent is extended or adjusted under 35 U.S.C. 154(b) by 0 days.

(21) Appl. No.: 09/767,118

(22) Filed: Jan. 22, 2001

(65) Prior Publication Data

US 2002/0096445 A1 Jul. 25, 2002

(51) Int. Cl.[7] ..... B65D 19/00
(52) U.S. Cl. ..... 108/51.11; 108/55.1
(58) Field of Search ..... 108/51.11, 513, 108/53.1, 55.3, 56.1, 90; 206/386; 220/1.5

(56) References Cited

U.S. PATENT DOCUMENTS

| | | | | | |
|---|---|---|---|---|---|
| 2,709,547 | A | | 5/1955 | Niedringhaus | |
| 2,908,122 | A | | 10/1959 | Allen | |
| 3,133,511 | A | * | 5/1964 | Phillips | |
| 3,348,673 | A | | 10/1967 | Bahls et al. | |
| RE26,426 | E | | 7/1968 | De Remer et al. | |
| 3,570,698 | A | | 3/1971 | Dougherty | |
| 3,949,874 | A | * | 4/1976 | Heavner | |
| 3,949,929 | A | * | 4/1976 | Kupersmit | |
| 4,000,815 | A | | 1/1977 | Wingbro et al. | |
| 4,416,385 | A | * | 11/1983 | Clare et al. | 220/1.5 |
| 4,429,794 | A | | 2/1984 | Steger et al. | |
| 4,453,471 | A | * | 6/1984 | Harrington et al. | 108/55.1 |
| 4,915,033 | A | * | 4/1990 | Bond | 108/55.1 |
| 4,976,365 | A | * | 12/1990 | Seo | 220/1.5 |
| 5,111,950 | A | | 5/1992 | Wylenzek | |
| 5,269,645 | A | | 12/1993 | Winski | |
| 5,388,702 | A | | 2/1995 | Jones | |
| 5,647,284 | A | * | 7/1997 | Frysinger et al. | 108/55.1 |
| 5,782,360 | A | | 7/1998 | Markson | |
| 5,918,551 | A | * | 7/1999 | Liu | 108/55.1 |
| 6,070,422 | A | | 6/2000 | Alvenes | |
| 6,105,511 | A | | 8/2000 | Bridges | |

* cited by examiner

*Primary Examiner*—Jose V. Chen
(74) *Attorney, Agent, or Firm*—John K. McCulloch

(57) ABSTRACT

A pallet cover has a top panel and side panels hinged to the top panel for swinging movements from a substantially vertical position depending from the top panel through an arc sufficient to enable each side panel to overlie the top panel. The pallet is provided with supports which enable it to be stacked with one or more other pallets and the cover is notched to accommodate the stacking supports and provide an interlock therewith to ensure retention of the cover on the associated pallet.

22 Claims, 5 Drawing Sheets

PALLET COVER

This invention relates to a removable and collapsible cover adapted to overlie a pallet and articles supported thereon.

BACKGROUND OF THE INVENTION

It is conventional to place workpieces or other articles atop a pallet either before or after such workpieces have been treated. In some instances the pallet functions as a storage area for the workpieces until such time as they are moved from one site to another. Some workpieces, such as those formed of sheet material, must be protected from contamination by foreign substances such as dust, particles, and liquids. If the workpieces are of the kind which are to be presented to forming dies, for example, the presence of dirt or other foreign objects on the workpieces may result in damage to the workpieces themselves or to the dies which act on the workpieces.

These problems have been recognized heretofore as a result of which it is common practice to enclose palletized workpieces in a protective wrapping. To ensure retention of the protective wrapping in place, it is conventional to utilize banding or strapping which encircles the wrapped workpieces. The materials used in providing protective wrapping of the kind referred to are expensive and require considerable time to apply to and remove from the palletized workpieces. In addition, the removal of the retaining strapping sometimes causes injury to the person or persons who perform the wrapping and removal operations. Disposal of the wrapping and strapping materials also presents problems.

A principal object of the invention is to provide a cover for palletized workpieces or other articles which overcomes the problems referred to above.

SUMMARY OF THE INVENTION

A pallet cover constructed in accordance with the preferred embodiment of the invention is reusable, adapted for use with conventional pallets requiring no modification of the latter, and provides complete cover for the palletized articles. The cover is formed from a unitary sheet of relatively stiff, form-stable plastics material and has a top or upper panel adapted to overlie a pallet and articles supported thereon. The upper panel has an area and configuration corresponding substantially to those of the pallet. A plurality of side panels depend from the edges of the upper panel and each side panel is of such area and configuration as substantially to occupy the space between the upper panel and the pallet. The side panels and the pallet have cooperable retaining means which enable the side panels releasably to be secured to the pallet in such manner that the cover encloses whatever is supported on the pallet.

The pallet preferably has at spaced intervals about its periphery sockets which accommodate posts that provide support for a second pallet overlying the lower pallet, thereby enabling pallets to be stacked vertically without subjecting the articles supported on a lower pallet to possible injury by an upper pallet. The cover's upper panel and side panels are notched at positions corresponding to those of the posts so as to enable the posts to extend above the cover and provide support for an upper pallet without damaging the cover.

The side panels of the cover are hinged to the upper panel for swinging movements from a position in which they depend from the upper panel through substantially 270° to a collapsed position in which they overlie and are substantially parallel to the upper panel. Following such movement of the side panels the cover may be lifted and moved to an area away from the pallet so as to enable articles to be placed on and removed from the pallet. The cover preferably has handles to facilitate lifting and transporting of the cover.

A pallet of the kind with which the cover is usable may have in its workpiece-supporting surface a plurality of openings in which upstanding positioning elements or pins may be accommodated for the purpose of retaining workpieces on the pallet surface in selected positions. The positioning pins are removable from their upstanding positions when no longer required. The pallet has one or more compartments in which the positioning pins may be stored when not in use.

The support posts which enable one pallet to be stacked atop another at a level above that occupied by workpieces supported on the lower pallet may be removed from the associated pallet and refitted thereto at a lowered position so that, once all the workpieces have been removed from a lower pallet, other pallets may be stacked one upon another, thereby reducing the overall height of the stacked pallets.

When an empty pallet is conditioned for transport the cover associated with such pallet may be returned, in collapsed condition, to such pallet and placed atop the latter. The notches in the panels will provide an interlock with the supporting posts, even when the latter are in their lowered positions, thereby ensuring retention of the collapsed cover on the pallet.

THE DRAWINGS

THE PREFERRED EMBODIMENT

Figure 1:
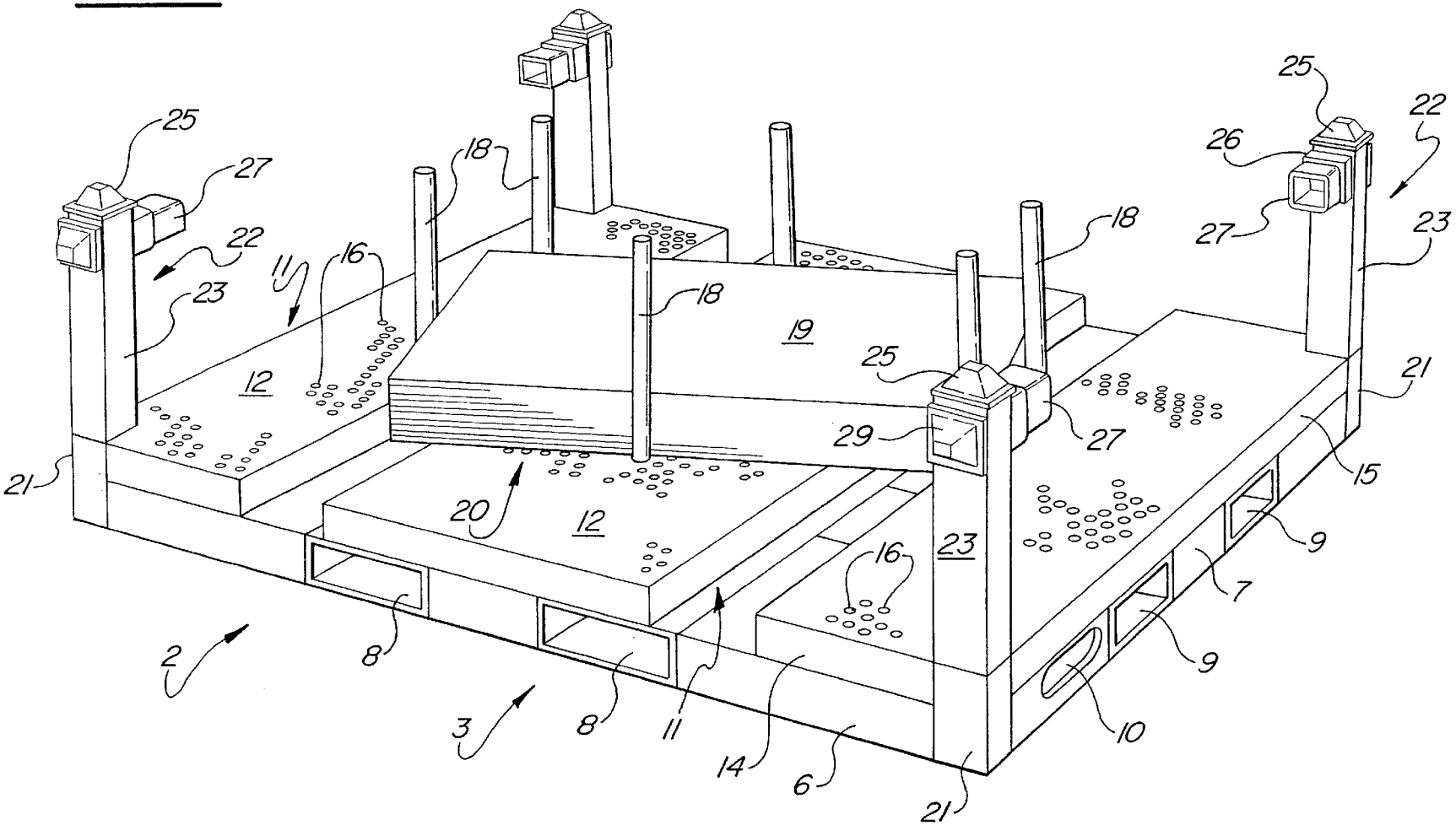
FIG. 1 is an isometric view of a conventional pallet of the type with which a cover constructed in accordance with the invention is adapted for use.

A cover constructed in accordance with the preferred embodiment of the invention is designated generally by the reference character 1 (FIG. 2) and is particularly well adapted for use in conjunction with a pallet 2 of conventional construction having a base 3 formed by vertically spaced frame members 4 and 5 (FIG. 4) joined by side and end members 6 and 7. Openings 8 and 9 are provided in the walls 6 and 7, respectively, for the accommodation of tines of a fork lift truck. One or both of the end walls 7 is provided with an opening 10 which provides access to a compartment for a purpose presently to be explained.

Figure 4:
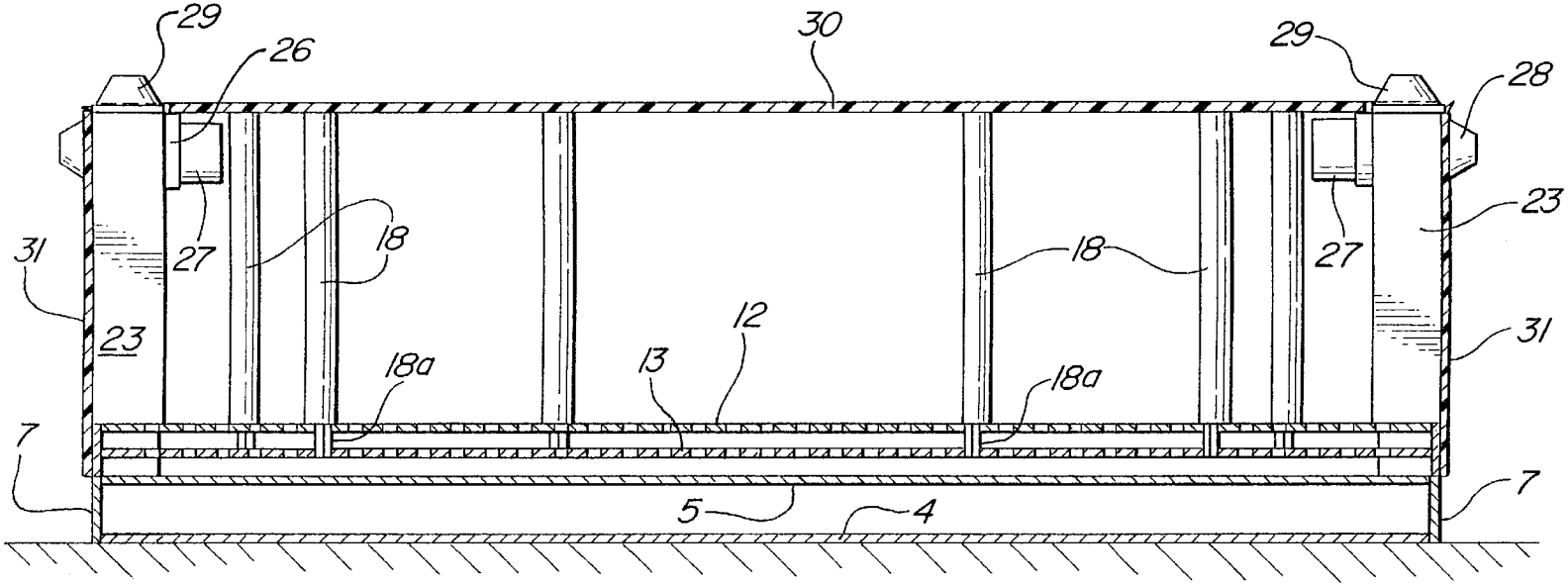
FIG. 4 is a longitudinal sectional view through the pallet and the cover.

Fixed to the upper member 5 is a plurality of blocks 11 composed of parallel, horizontal plates 12 and 13 (FIG. 4)

maintained in fixed position by side and end walls 14 and 15. The members 12 and 13 are provided with a plurality of vertically aligned openings 16 for the removable accommodation of upstanding positioning elements or pins 18. The openings 16 preferably are hexagonal and the lower ends 18*a* of the pins 18 are similarly or otherwise suitably shaped and offset from the longitudinal axis of the remainder of each pin, thereby enabling each pin 18 to be fixed in any selected one of a number of angularly adjusted positions.

The upper plate 12 forms a flat, horizontal surface on which workpieces 19 may be supported. As shown, the workpieces 19 comprise metal sheets arranged in a stack 20. As is shown in FIG. 1, the positioning pins 18 are so positioned as to maintain the stack 20 in a desired position atop the pallet 2.

At spaced intervals about the perimeter of the pallet is a plurality of vertically extending socket-forming members 21. Removably accommodated in the socket of each of the members 21 is a supporting post 22 having an enlarged section 23 terminating at one end in a reduced section 24 of such size as to be fitted into any one of the socket-forming members 21. At its opposite end each of the posts 22 has a projecting tip 25 of truncated pyramidal form. Each post 22 has, adjacent the tip 25, a short extension 26 of the same cross sectional area as that of the section 23 and which terminates in a reduced, auxiliary extension 27 of such size as to be accommodated in the socket formed by any one of the members 21. The auxiliary extension also is provided at its opposite end with a tip 29 like the tip 25.

When the pallet is in the condition shown in FIG. 1 the positioning pins 18 project above the stack 20 of workpieces as do the supporting posts 22. The posts 22 make possible the stacking of other pallets 2 atop one another and the pins 18 and the posts 22 prevent an upper pallet from damaging workpieces supported on a lower pallet. It is contemplated that the underside of each pallet may be recessed to accommodate the tip 25 of the post. When the positioning pins 18 no longer are required, they may be removed from the openings in which they are accommodated and passed through the openings 10 into the associated compartments for storage.

Figure 5:
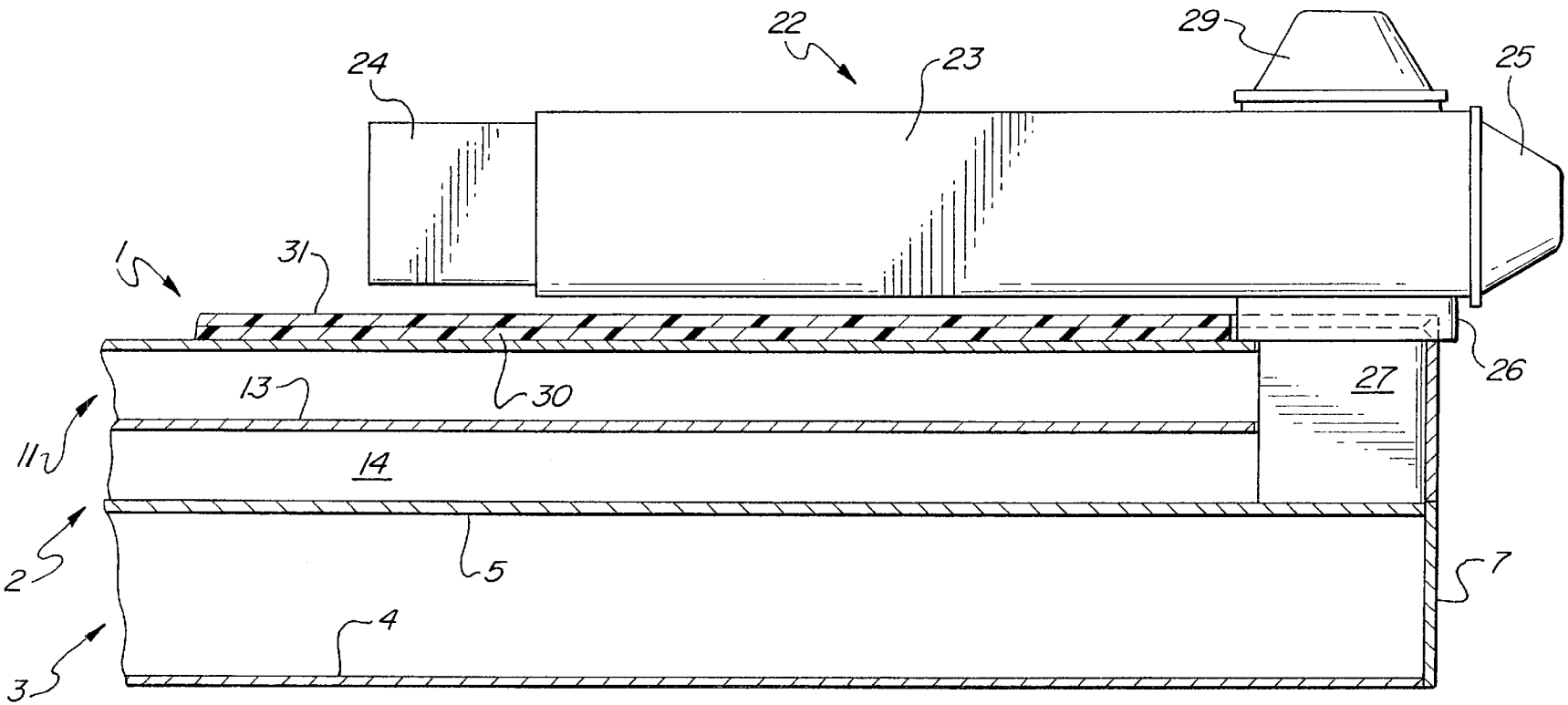
FIG. 5 is a fragmentary, enlarged, partly elevational and partly sectional view of an empty pallet in condition for transport and with the cover in collapsed condition atop a pallet.

When the workpieces and positioning pins have been removed the supporting posts 22 may be removed from the sockets whereupon the auxiliary extensions 27 may be fitted into such sockets, as is shown in FIG. 5, thereby reducing considerably the height that the posts 22 extend above the workpiece-supporting surface of the pallet. The tips 29 then function in the same manner as the tips 25 to provide support for an overlying pallet.

The pallet 2, the positioning pins 18, and the supporting posts 22 disclosed herein are conventional and form no part of the invention except for the manner in which they cooperate with the cover 1 yet to be described.

Figure 6:
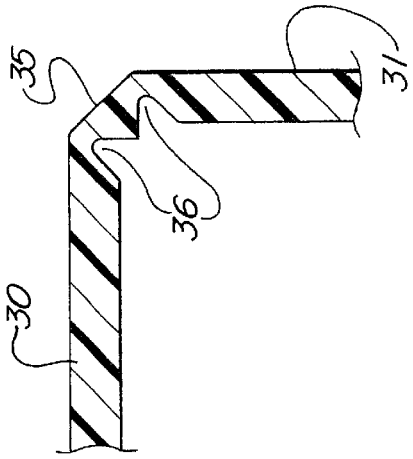
FIG. 6 is a fragmentary, sectional, enlarged view of the juncture between the top panel and one side panel of the cover.

The cover 1 is formed from one or more sheets of suitable, relatively stiff material, such as corrugated polyethylene, sheet metal, or laminated paper and has a planar top or upper panel 30 to which is joined a plurality of planar side panels 31. The upper panel 30 is notched at 32 and each side panel is notched at 33 for the accommodation of the upper end of the supporting posts 22. Each of the side panels also is of such length from end to end as to provide a slot 34 for the accommodation of a part of the section 23 of the adjacent supporting post. At the juncture of each side panel 31 with the upper panel 30 is a hinge joint 35. The hinge joint could be formed by scoring which reduces the thickness of the material between the panels 30 and 31, or a fabric or plastic tape could bridge adjacent edges of the panels 30 and 31. Preferably, each side panel 31 is provided with additional scores 36 parallel to and spaced from one another, as is shown in FIG. 6, the spacing between adjacent scores being at least as great as the thickness of the material from which the side panel is formed. The purpose of the scores 36 and their spacing will be explained subsequently.

To condition the apparatus described thus far for use, workpieces may be stacked or otherwise mounted on the upper, supporting surface of the pallet and maintained in a selected position by means of the positioning pins 18. If desired, a conventional barrier sheet (not shown) of preferably waterproof plastic material may be interposed between the workpieces and the supporting surface of the pallet, and such sheet should be formed of material sufficiently weak as to be pierced by the positioning pins 18 and the supporting posts 22. The pins 18 and the supporting posts 22 then may be fitted to the pallet in the manner shown in FIG. 1.

Figure 2:
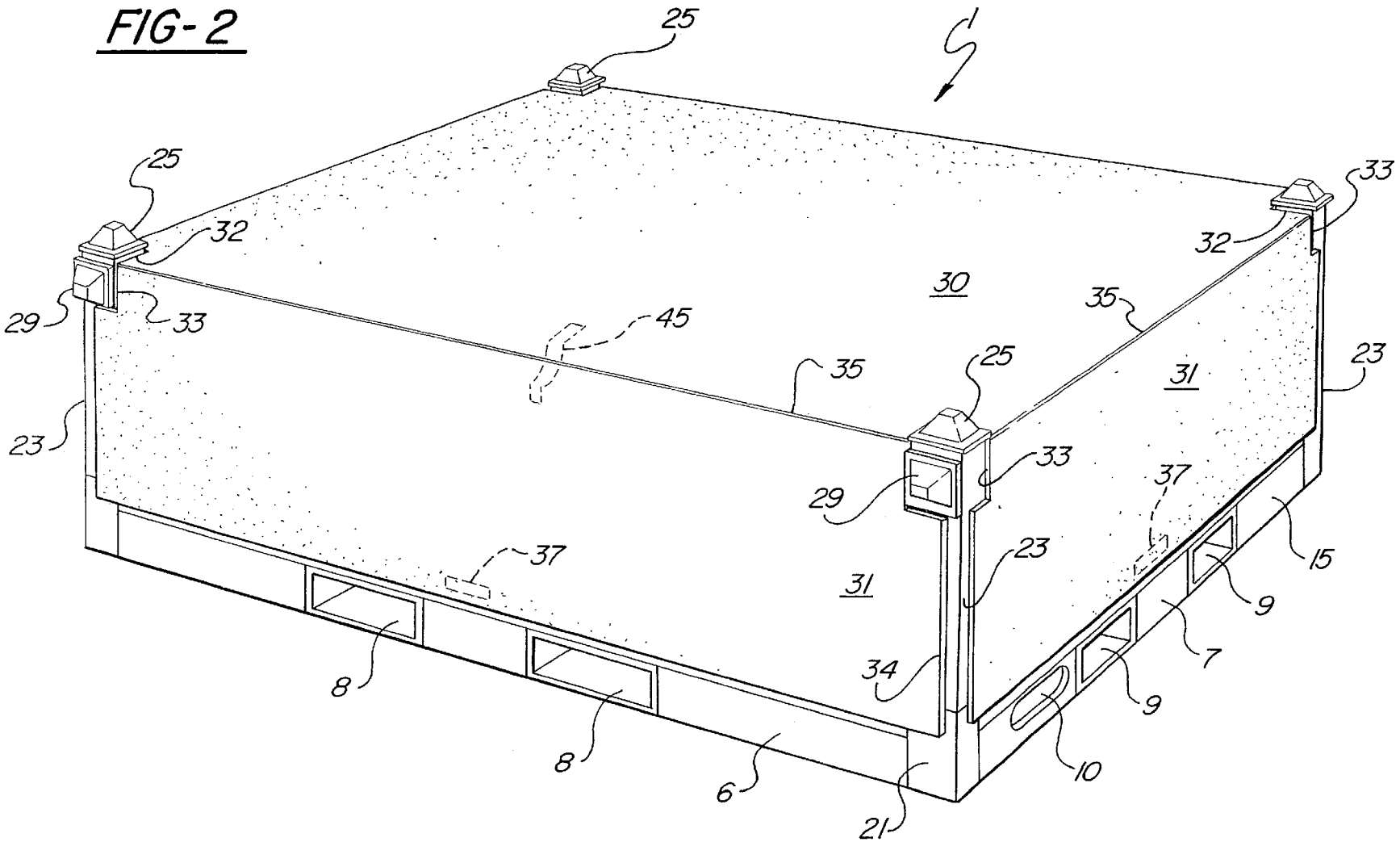
FIG. 2 is an isometric view of the pallet shown in FIG. 1 and fitted with a cover according to the invention.

The cover 1 then may be applied to the pallet in such manner that the upper panel 30 overlies the stack of workpieces and rests upon the upper ends of the positioning pins 18. The notches 32 in the upper panel 30 will accommodate the upper ends of the support posts 22 and thereby provide an interlock with the latter to ensure retention of the cover within the area between such posts. The side panels 31 will depend vertically from the upper panel and, as is best shown in FIG. 2, the side panels are of such area as substantially to occupy and fill the space between the upper panel 30 and the pallet base between adjacent support posts 22. In these positions of the side panels the notches 33 and the slots 34 accommodate the support posts.

Preferably, the material forming the cover is opaque, thereby enabling the kinds of workpieces enclosed by the cover to be obscured from view. However, if desired, the cover may be transparent, or provided with transparent windows to enable the pallet's contents to be viewed.

If desired, releasable retaining means may be provided to maintain the side panels 31 in their depending positions and thereby provide protection against the entry of foreign materials into the interior of the cover. In one form, the retaining means may comprise magnets 37 which, when the side panels are in their depending positions, extend to a level below that of the workpiece supporting surface of the pallet so as to engage the adjacent side of the support. If the pallet is formed of magnetically permeable material, the magnets will be attracted thereto. If not, the sides of the pallet may be fitted with magnetically permeable strips in zones to confront and engage the magnets. If desired, the magnets may be carried by the side panels adjacent their ends so as to overlie and react with the posts 22.

Figure 9:
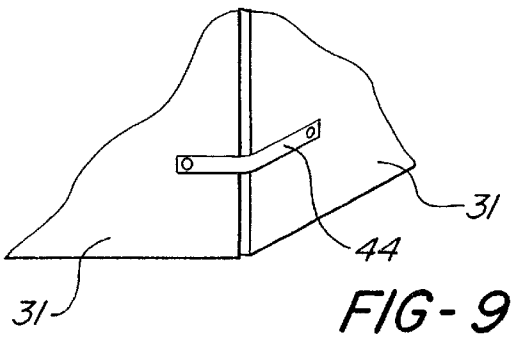
FIGS. 7, 8, and 9 are fragmentary views illustrating alternative kinds of retainers for releasably latching the side panels in pallet-enclosing condition.
Figure 8:
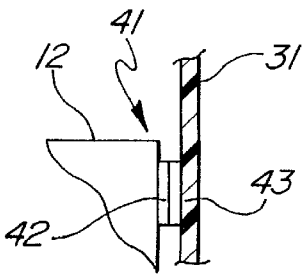
Figure 7:
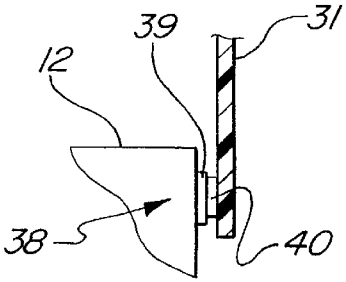

FIGS. 7, 8, and 9 illustrate alternative forms of retaining means. In FIG. 7 the retaining means comprises a conventional snap fastener 38 having a first member 39 secured to the pallet and a second member 40 secured to the panel 31. In FIG. 8 the retaining means 41 comprises confronting strips 42 and 43, one of which is provided with fabric-like hooks and the other of which is provided with fabric-like loops. In FIG. 9 a strap 44 has its opposite ends removably secured to adjacent ends of adjacent side panels, the strap ends being secured by any of the securing means referred to earlier. Such strips are readily available under the trademark VELCRO. Other kinds of retaining means may be utilized, such as interlocking tongue and groove fasteners.

Figure 3:
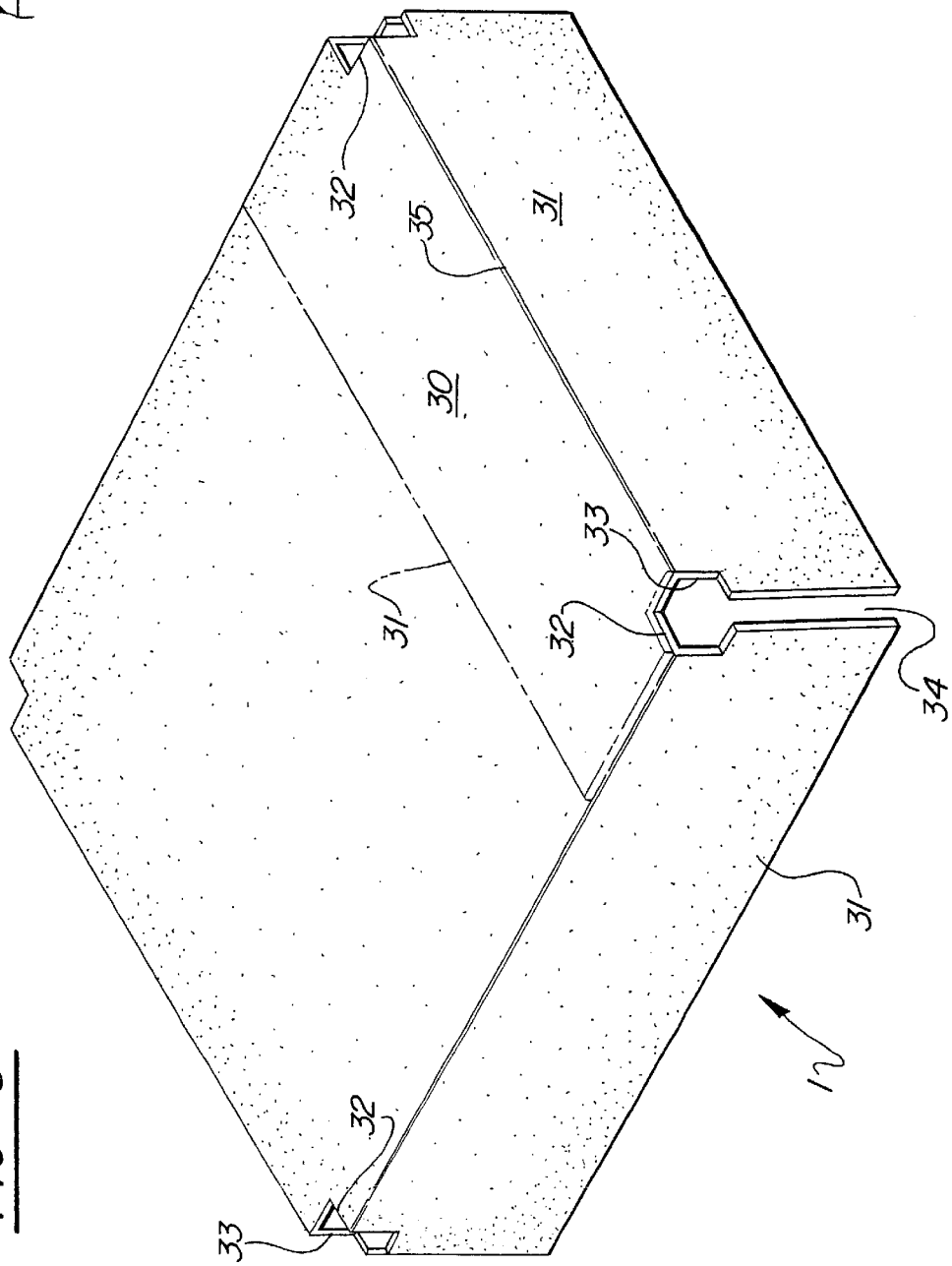
FIG. 3 is an isometric view of the cover itself.

When a pallet containing workpieces enclosed within the cover is to be unloaded, the side panels 31 are swung upwardly independently of one another from their depending positions through an arc which is sufficiently greater than 180° that each side panel will overlie and occupy a position substantially parallel to the upper panel 30. Preferably, each side panel is movable through an arc of about 270°. When the side panels are in their adjusted positions, one of the side panels may lie flat upon the upper panel 30 as is indicated in chain lines in FIG. 3 and in full lines in FIG. 5. When an adjacent side panel is swung to its adjusted position, it will not lie flat upon the upper panel, but instead will overlie a portion of the previously adjusted side panel. The second side panel, therefore, must hinge about a point other than that at which the first side panel hinges if the second panel is not to extend obliquely to the horizontal. It is for this purpose that the multiple scores 36 are provided. The additional scores make it possible for a second side panel to be swung to a position in which it is spaced from the upper panel 30 by the thickness of the first adjusted side panel and occupy a position parallel to the upper panel 30 and the underlying first side panel 31.

When all of the side panels have been swung upwardly to a position overlying the upper panel 30, the cover will be in a collapsed condition and can be moved away from the underlying pallet to a storage position. To facilitate movement of the collapsed pallet flexible grips or handles 45 (FIG. 2) span the hinge joints between the upper panel and two opposite side panels and are accessible when the cover is in its collapsed condition. Each handle has one end secured to the inner surface of the panel 30 and the opposite end to the inner surface of the adjacent side panel.

When the workpieces have been removed from the pallet and the latter is to be transported, the supporting posts 22 may be removed from the pallet. The collapsed cover then may be placed atop the workpiece supporting surface and the posts 22 reassembled with the pallet in lowered positions as shown in FIG. 5. Again, the notches 32 and 33 will accommodate the adjacent portions of the support posts and be interlocked therewith so as to avoid inadvertent separation of the pallet and the cover. One or more other pallets then may be placed atop one another and moved from one site to another.

A cover constructed in accordance with the invention is reusable and quickly may be applied to and removed from a pallet without the need for any tools or materials other than the cover itself.

The disclosed embodiment is representative of a presently preferred form of the invention, but is intended to be illustrative rather than definitive thereof. The invention is defined in the claims.

We claim:

1. A cover for a pallet or the like having a base forming an upper surface on which articles removably may be supported, said cover comprising a substantially planar upper panel of such rigidity as to be form-stable and having an area corresponding substantially to that of said surface so that said panel may overlie and cover said surface and articles supported thereon; a plurality of side panels; and hinge means joining each of said side panels to a different edge of said upper panel for independent swinging movements through an arc from a first position depending from said upper panel to a second position overlying said upper panel, the area of each of said side panels being such that when said upper panel overlies and is spaced above said base and when said side panels are in said first position each said side panel may substantially occupy the space between said upper panel and said base.

2. The cover according to claim 1 including releasable retaining means carried by each of said side panels and operable when said upper panel overlies said base and when said side panels occupy said first position releasably to retain each of said side panels in said first position.

3. The cover according to claim 2 wherein said retaining means is magnetic.

4. The cover according to claim 2 wherein said retaining means comprises cooperable and separable snap fasteners.

5. The cover according to claim 2 wherein said retaining means comprises separable loop and hook fasteners.

6. The cover according to claim 1 wherein each of said hinge means is formed by scoring of the associated side panel adjacent its juncture with said upper panel.

7. The cover according to claim 1 wherein the hinge means of each of said side panels is formed by multiple scores adjacent its juncture with said upper panel, said scores being spaced from and substantially parallel to one another.

8. The cover according to claim 7 wherein each of said side panels is of substantially uniform thickness and wherein the spacing between adjacent ones of said scores is at least as great as said thickness.

9. The cover according to claim 1 including a plurality of handles, each of said handles comprising an elongate flexible grip secured at one of its ends to said upper panel and at its opposite end to one of said side panels, said handle spanning the associated hinge means and being accessible following movement of the associated side panel to said second position.

10. A cover for use with a pallet of the kind having a base forming an upper surface on which articles removably may be supported and a plurality of spaced apart, substantially uniform height, upwardly projecting positioning elements removably carried by said base for maintaining articles in selected positions on said surface, said cover comprising a substantially planar upper panel of such rigidity so as to be form-stable and of such area as to occupy an operative position overlying said surface and articles supported thereon and be spaced therefrom a distance corresponding substantially to the height of said elements; and a plurality of side panels of such rigidity as to be form-stable and hingedly joined to different edges of said upper panel for swinging movements when said upper panel occupies said operative position through an arc between a first position in which each of said side panels depends from said upper panel and spans the space between said upper panel and said surface, to a second position in which each of said side panels overlies said upper panel, each of said side panels having an area sufficient to occupy and substantially fill the associated space.

11. The cover according to claim 10 wherein each of said side panels has a height sufficient to extend from said upper panel to a level below that of said upper surface and alongside said base.

12. The cover according to claim 11 including releasable retaining means carried by each of said side panels and operable when said upper panel occupies said operative position and when said side panels occupy said first position to releasably retain each of said side panels in said first position.

13. The cover according to claim 10 wherein said upper panel has a plurality of notches for the accommodation of posts carried by said base may extend.

14. The cover according to claim 10 wherein each of said hinge means is formed by scoring the associated side panel adjacent its juncture with said upper panel.

15. The cover according to claim 10 wherein the hinge means of each of said side panels is formed by multiple scores adjacent its juncture with said upper panel, said scores being spaced from and substantially parallel to one another.

16. The cover according to claim 10 wherein said cover is formed from a unitary, flat sheet of material.

17. The cover according to claim 10 wherein said arc is substantially 270°.

18. A pallet and cover combination comprising a pallet having a base including a surface on which articles may be supported;

a cover having an upper panel of such rigidity as to be form-stable and overlying and vertically spaced from said surface and having an area corresponding substantially to that of said surface;

said cover having a plurality of side panels hingedly joined to different edges of said upper panel for swinging movements through an arc between a first position in which each of said side panels depends from said upper panel and spans the space between said upper panel and said surface, to a second position in which each of said side panels overlies said upper panel; and each of said side panels having an area sufficient to occupy and substantially fill the associated space when said side panels are in said first position.

19. The combination according to claim 18 wherein each of said side panels has a height sufficient to extend from said upper panel to a level below that of said upper surface and alongside said base.

20. The combination according to claim 18 including releasable retaining means reacting between each of said side panels and said base when said side panels occupy said first position for releasably retaining each of said side panels in said first position.

21. The combination according to claim 18 wherein said base has at its periphery a plurality of spaced apart, upstanding posts and wherein said panels have notches through which said posts extend.

22. The combination according to claim 21 wherein said base has a plurality of sockets and wherein each of said posts is removably accommodated in one of said sockets.

* * * * *